United States Patent [19]

Page

[11] 4,223,481

[45] Sep. 23, 1980

[54] STORM WINDOW

[76] Inventor: Edward J. Page, Hampton, Va.

[21] Appl. No.: 968,767

[22] Filed: Dec. 12, 1978

Related U.S. Application Data

[63] Continuation of Ser. No. 798,593, May 19, 1977, abandoned.

[51] Int. Cl.[3] ..... E05C 7/02

[52] U.S. Cl. ..... 49/63

[58] Field of Search ..... 49/63, 62, 61; 52/202, 52/203

[56] References Cited

U.S. PATENT DOCUMENTS

| | | | |
|---|---|---|---|
| 2,511,341 | 6/1950 | Johnson | 49/63 |
| 3,043,369 | 7/1962 | Falotico | 49/63 |
| 3,121,922 | 2/1964 | Niese | 49/63 |
| 3,177,924 | 4/1965 | McPhail | 49/63 X |
| 3,222,734 | 12/1965 | Punt | 49/63 |
| 3,226,779 | 1/1966 | Rust | 49/63 |
| 3,239,976 | 3/1966 | Hall | 52/202 |
| 3,908,730 | 9/1975 | Goss, Jr. et al. | 49/63 |
| 3,992,815 | 11/1976 | Potter | 49/62 |

*Primary Examiner*—Philip C. Kannan
*Attorney, Agent, or Firm*—Mills & Coats

[57] ABSTRACT

A storm window type closure which is adapted to be installed adjacent the interior side of an existing primary window unit. The present invention incorporates a main frame and associated runner assembly of such a low profile that the designed movement of the primary window unit may be accomplished without undue obstruction thereby allowing convenient access to the same. Additionally the present invention provides a substantial dead air space between the primary window and the storm window thereby increasing both the acoustic and thermal insulation qualities of the same.

The present invention relates to windows and more particularly to storm windows which are adapted to be installed adjacent a preexisting primary window unit.

8 Claims, 6 Drawing Figures

STORM WINDOW

This is a continuation application of United States Patent Application Ser. No. 798,593, filed May 19, 1977, now which is abandoned.

BACKGROUND OF THE INVENTION

Storm windows were initially developed as an auxiliary closure to be installed about the exterior side of a primary window unit commonly found in homes and buildings. These storm windows were adapted to be utilized during the cold months of the year to insulate primary windows against wind, moisture and cold.

The first storm windows, for example, may have been nothing more than a piece of sheet metal that was patterned to cover the entire exterior opening of a preexisting primary window. This method functioned to insulate primary windows, however, the disadvantage is obvious of using an opaque material. Therefore, storm windows were developed which incorporated a glass pane supported by a frame which was attached about the exterior side of the primary window unit. This type of storm window not only insulated the primary window unit but also permitted light to enter the home or building. However, this large pane was awkward to install and since it did not incorporate a movable sash, it had to be taken down in order to ventilate the home or building on mild days which may occur during the winter months. Later storm windows have incorporated movable sashes which permitted the storm window to be left in place year around because the lower sash of the storm window could be raised and locked in place thereby allowing ventilation of the building or home when the primary window unit was opened.

In the past storm windows were used primarily in the northern latitudes to insulate primary windows during the winter months. But, in recent years the energy crisis has prompted homeowners situated in all temperature zones to employ storm windows in both the winter and summer months to increase the efficiency of both heating and air conditioning systems. Therefore, a great deal of importance is now being placed on the development of newer and more effective storm window systems.

It is of particular interest to note that many buildings constructed prior to the last five years were not designed with energy conservation in mind. For instance, many high rise office buildings were given an attractive exterior veneer of plate glass which provided little insulation for the building and necessitated the installation of heating and air conditioning units of large capacities.

The energy crisis and subsequently the increased cost of energy is causing building owners to seek out ways to renovate existing buildings such that heating and air conditioning demands are effectively reduced. On buildings with a large amount of single layer glass, it appears that storm windows are the obvious solution. However, storm windows that are installed about the exterior of a building especially a high rise building are expensive to install and difficult to maintain. Additionally, the exteriorly installed storm window may drastically alter the appearance of the building on which they are placed.

Another consideration to be taken into account when discussing the application of storm windows to preexisting primary windows is whether or not the storm window system is adaptable to various primary window systems having a variety of movable sashes. This is of particular importance when it is appreciated that primary windows may be of the hopper, awning, or pivot type as well as any combination thereof. It should be appreciated that unobstructed movement of the primary window is necessary in order to facilitate periodic maintenance or repair of the same.

SUMMARY OF THE INVENTION

After much research and study into the above mentioned problems, the storm window system of the present invention has been developed to effectively insulate a primary window unit of a building against both thermal and acoustic conditions which may exist exteriorly of said building.

In addition the present invention is adapted to be installed on the interior side of the primary window unit without interfering with the design movement of the same.

In view of the above, it is an object of the present invention to present a storm window system that insulates a primary window against undesirable acoustic and thermal conditions which may exist exteriorly of the building about which the storm window system is installed.

Another object of the present invention is to provide a storm window system which may be installed from the interior of the building and disposed adjacent the interior side of a preexisting primary window unit.

Another object of the present invention is to present a storm window system which incorporates a runner extrusion being removably attached to a main frame whereby a sash may be slidably mounted therein.

A further object of the present invention is to provide a storm window system that incorporates sashes which may be slidably mounted for either horizontal or vertical movement.

An even further object of the present invention is to provide a storm window system which comprises a main frame and runner assembly of such a low profile that primary window sash movement is not impeded or obstructed.

In addition, another object of the present invention is to provide a storm window system which comprises a main frame adapted to be disposed adjacent the interior periphery of a primary window unit.

Another object of the present invention is to provide a storm window system which adapts a vibration absorbing interface disposed between the primary window unit and the main frame of the storm window.

Another object of the present invention is to provide a storm window system which creates a dead air space of substantial volume between the primary and storm window sashes thereby enhancing the thermal insulation capabilities of the storm window.

A further object of the present invention is to provide a storm window system which is substantially tamperproof whereas the sashes may not be easily removed by an unauthorized individual.

Another object of the present invention is to provide a storm window system which incorporates overlappingly moving panels thereby increasing free air space when such is required.

Additionally, another object of the present invention is to provide a storm window system which incorporates a main frame composed of such a material and design that it may be incorporated as a structural rather than an architectural member, thereby expanding its use to that of a load bearing wall member.

Other objects and advantages of the present invention will become apparent from a study of the following description and the accompanying drawings which are merely illustrative of the present invention.

DETAILED DESCRIPTION OF PREFERRED EMBODIMENT

Figure 1:
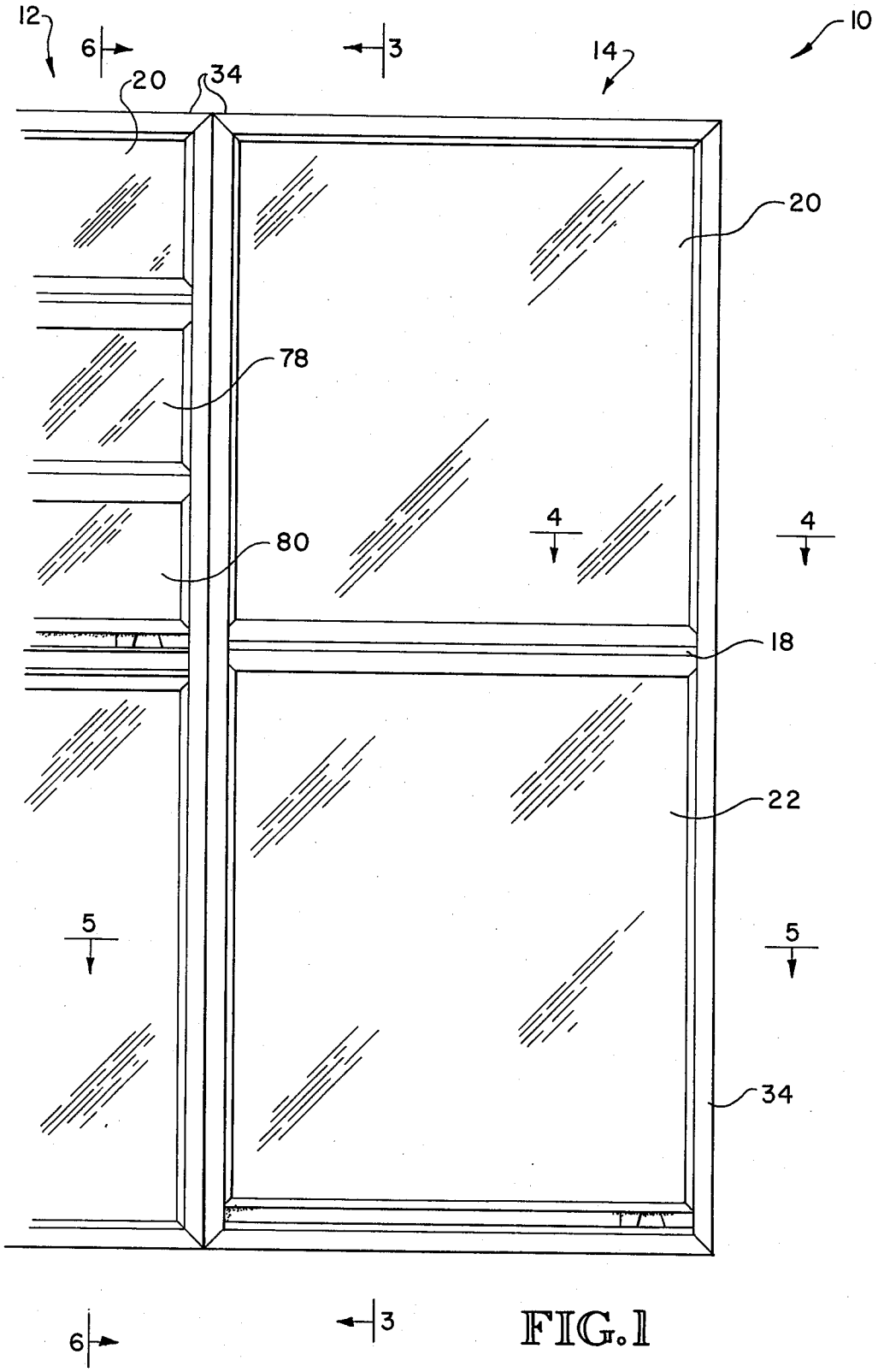
FIG. 1 is a front elevational view of the present invention illustrating two storm windows of the present invention being disposed side by side adjacent a primary window unit as would be viewed from the interior of the building.

With further reference to the drawings, particularly FIG. 1, the storm window system of the present invention is shown therein and generally indicated at 10. Storm window system 10 of FIG. 1 is comprised of two exemplary storm windows indicated generally at 12 and 14 which are disposed adjacent one another in the particular configuration illustrated.

Storm window 14 is basically rectangular in shape with a main frame 16 extending about its periphery and thereby structurally stabilizing the same. Storm window 14 is further comprised of a mullion 18 which extends between two oppositely opposed members of frame 16 and is removably attached to the same. Mullion 18 is adapted to support a stationary sash 20 which is disposed within an upper portion of main frame 16. Furthermore, as will be hereinafter described in greater detail, mullion 18 is adapted to provide a sealing means between a lower movable sash 22 and the stationary sash 20.

A fragmentary elevational view of storm window 12 is also shown in FIG. 1 and illustrates an alternate arrangement for adapting movable and stationary sashes within a main frame structure.

Figure 2:
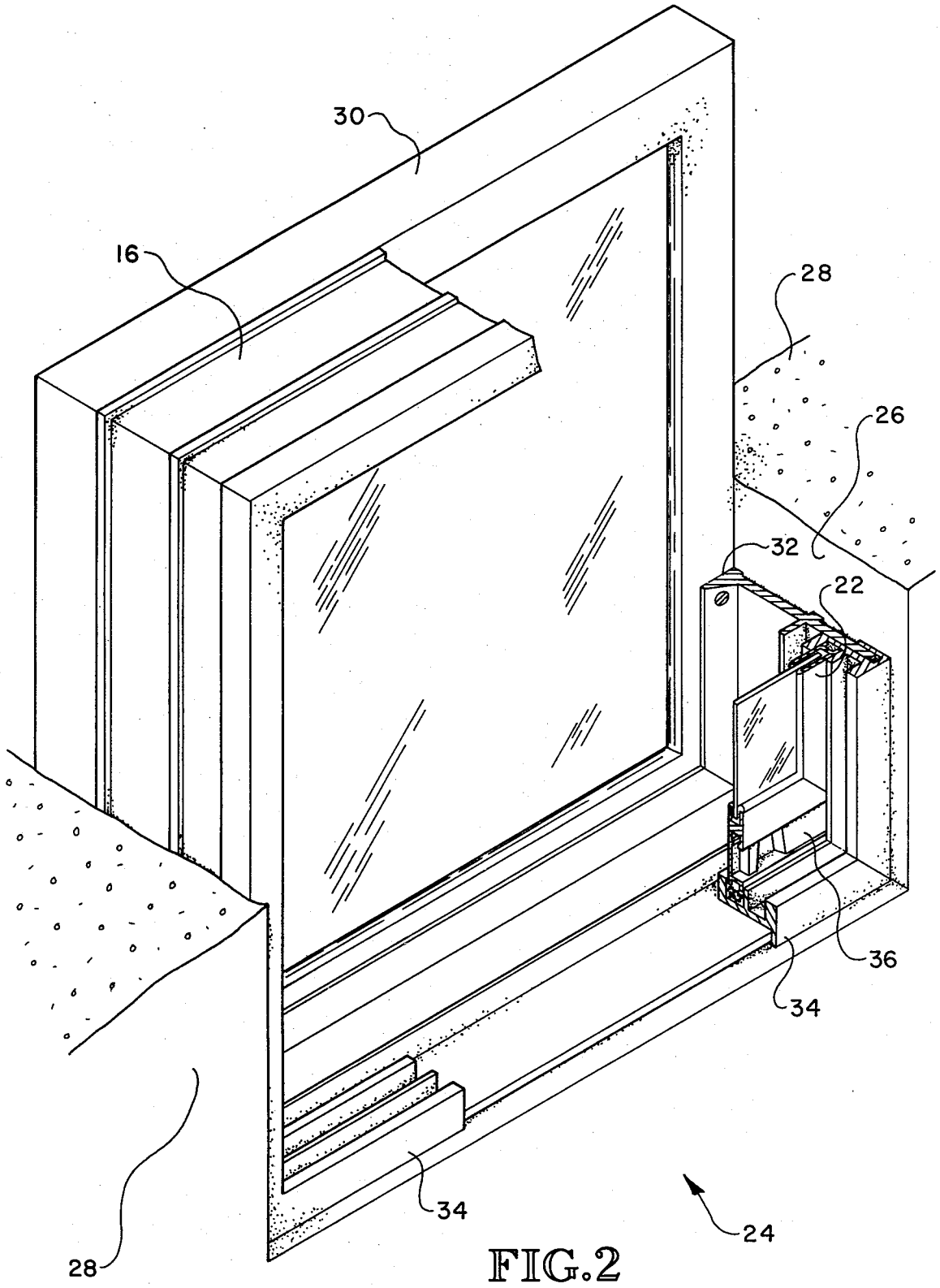
FIG. 2 is a fragmentary perspective view of the storm window system of the present invention installed adjacent a primary window unit and therein showing the surrounding wall cut away thereby exposing the outer surface of the main frame as viewed from the interior top left side of the window.

Referring to FIG. 2, a fragmentary perspective view of an installed storm window of the present invention is shown therein with the storm window being generally indicated by the numeral 24. Storm window 24 of FIG. 2 is disposed within an opening 26 which extends through wall 28. FIG. 2 further illustrates the particular relationship of the storm window 24 to a preexisting primary window unit 30. It should be pointed out at this time, when viewing FIG. 2, that substantially all storm window units of the present invention bear the same relationship that storm window 24 has with wall 28 and primary window unit 30.

Viewing FIG. 2 in greater detail, it can be appreciated that storm window 24 includes a main frame 16 which not only provides structural integrity to the same but also incorporates a mounting flange 32. Furthermore, main frame 16 comprises a removably attached runner extrusion 34 which slidably secures movable sash 22 to storm window 24. It can be appreciated by anyone skilled in the art that the slidable sashes of the present invention may be secured in a closed or various incrementally opened positions using round through hole latch pins 36.

Figure 3:
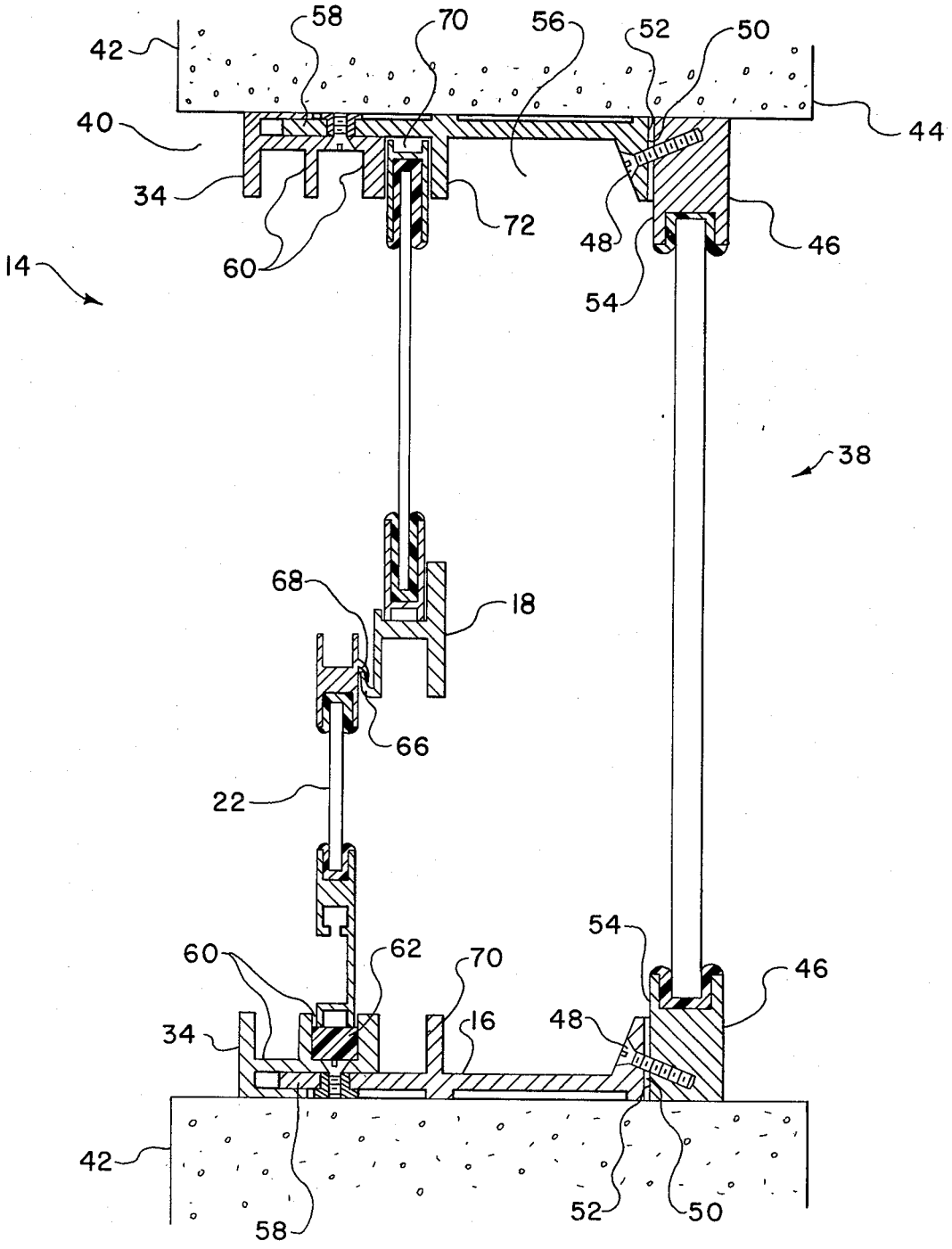
FIG. 3 is a cross sectional view of the present invention taken along lines 3—3 of FIG. 1.

Viewing FIG. 3 which is taken along lines 3—3 of FIG. 1, a cross sectional view of storm window 14 is shown therein disposed adjacent the interior side of a preexisting primary window unit indicated generally at 38. Both primary window unit 38 and its removably attached storm window 14 are disposed within an opening 40 which extends through wall 42 and insulate the same from both acoustic and thermal conditions which may exist on the exterior side 44 of wall 42.

As viewed in FIG. 3, main frame 16 of storm window 14 is removably secured adjacent frame 46 of primary window unit 38 by a means such as screw 48. Prior to securing main frame 16 adjacent frame 46 an insulating interface 50 is positioned between common surfaces 52 and 54 of frames 16 and 46. Insulation interface 50 is generally constructed of a foam tape such that the interface is of uniform thickness.

Main frame 16 extends perpendicularly inward from primary window unit 38 and therefore along interior opening 40 of wall 42. The sash assembly associated with this storm window is disposed across the most inward extension of main frame 16 thereby creating a dead air space 56 of substantial volume between primary window unit 38 and storm window 13.

Figure 4:
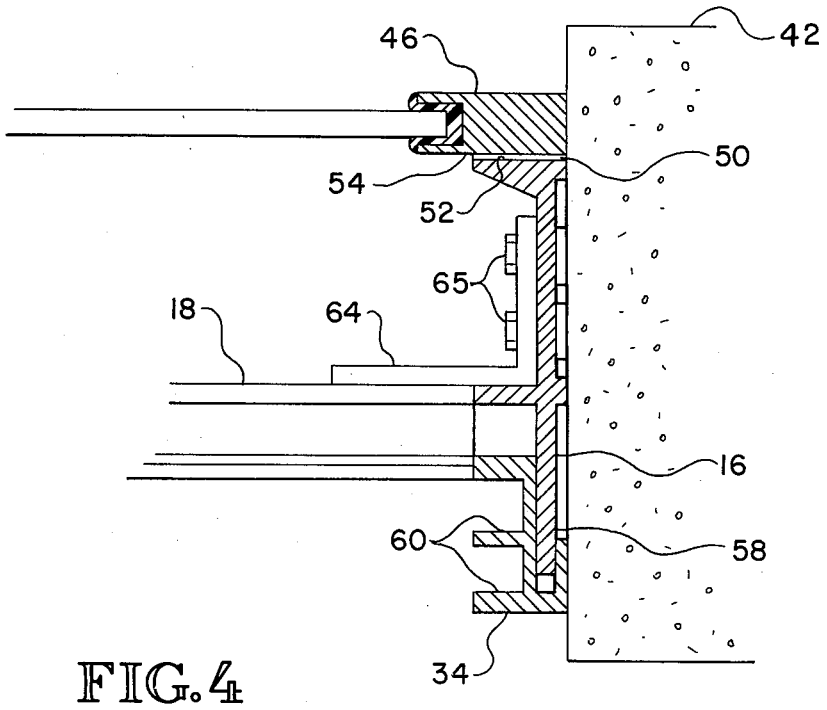
FIG. 4 is a cross sectional view of the present invention taken along lines 4—4 of FIG. 1.

As viewed in FIG. 3, and in FIG. 4 which is taken along lines 4—4 of FIG. 1, it is seen that a runner extrusion 34 such as used in FIG. 2 extends along the most inward extension 58 of main frame 16. Runner extrusion 34 is removably attached to main frame 16 by a screw 48 or other suitable attaching means which may be disposed within a groove 60 of runner extrusion 34.

FIG. 3 illustrates a storm window of the present invention being in the closed mode with the lower movable sash 22 resting on a foam strip 62 disposed within a groove 60 of runner extrusion 34. Movable sash 22 also seals with a mullion 18 at its uppermost end when in the closed mode.

Mullion 18 which extends horizontally across the storm window 14 is removably attached to two opposed sides of main frame 16. A bracket 64 is secured about each end of mullion 18 and is removably attached to main frame 16 by screws 65 or other suitable attaching means. Mullion 18 incorporates a sealing lip 66 which interlocks a matching sealing lip 68 disposed along the width of movable sash 22. In addition, mullion 18 supports an upper stationary sash 20 which is sealed about its remaining periphery by a groove 70 formed between runner extrusion 34 and a rail 72 extending inward from main frame 16.

Figure 5:
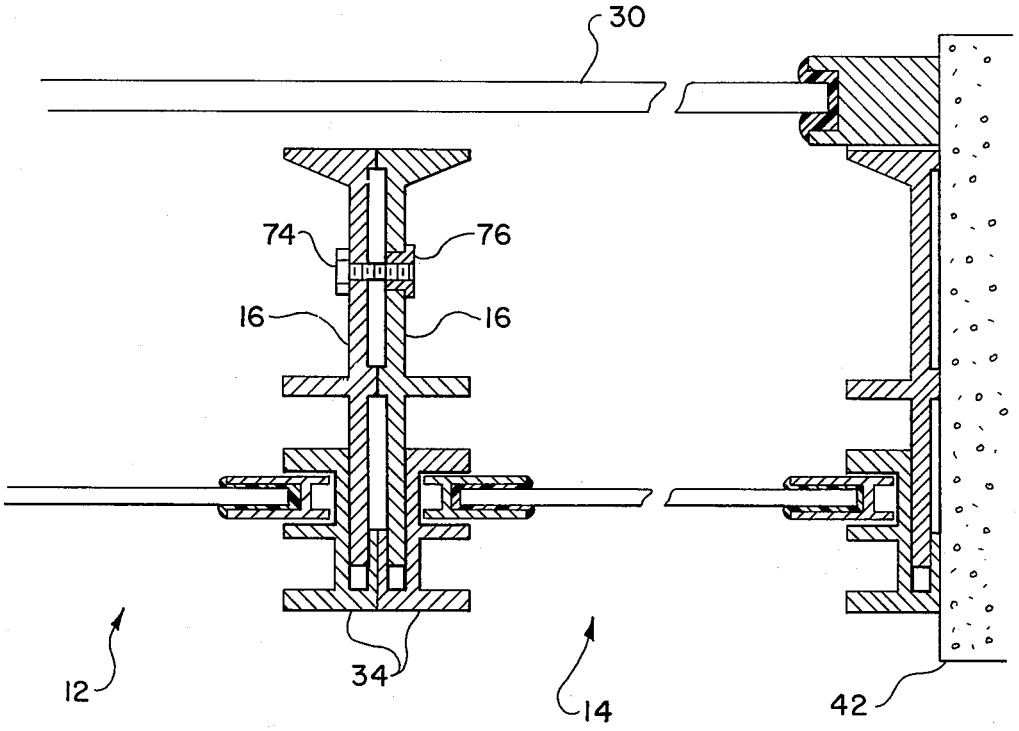
FIG. 5 is a cross sectional view of the present invention taken along lines 5—5 of FIG. 1.

FIG. 5, which is a section view taken along lines 5—5 of FIG. 1, illustrates the structural qualities of main frame 16 when two or more storm windows are placed in a series side by side. In this particular configuration, main frame 16 of storm window 14 is placed adjacent the main frame 16 of storm window 12 with the two frames being removably held together by suitable attaching means such as bolt 74 and weld nut 76.

Figure 6:
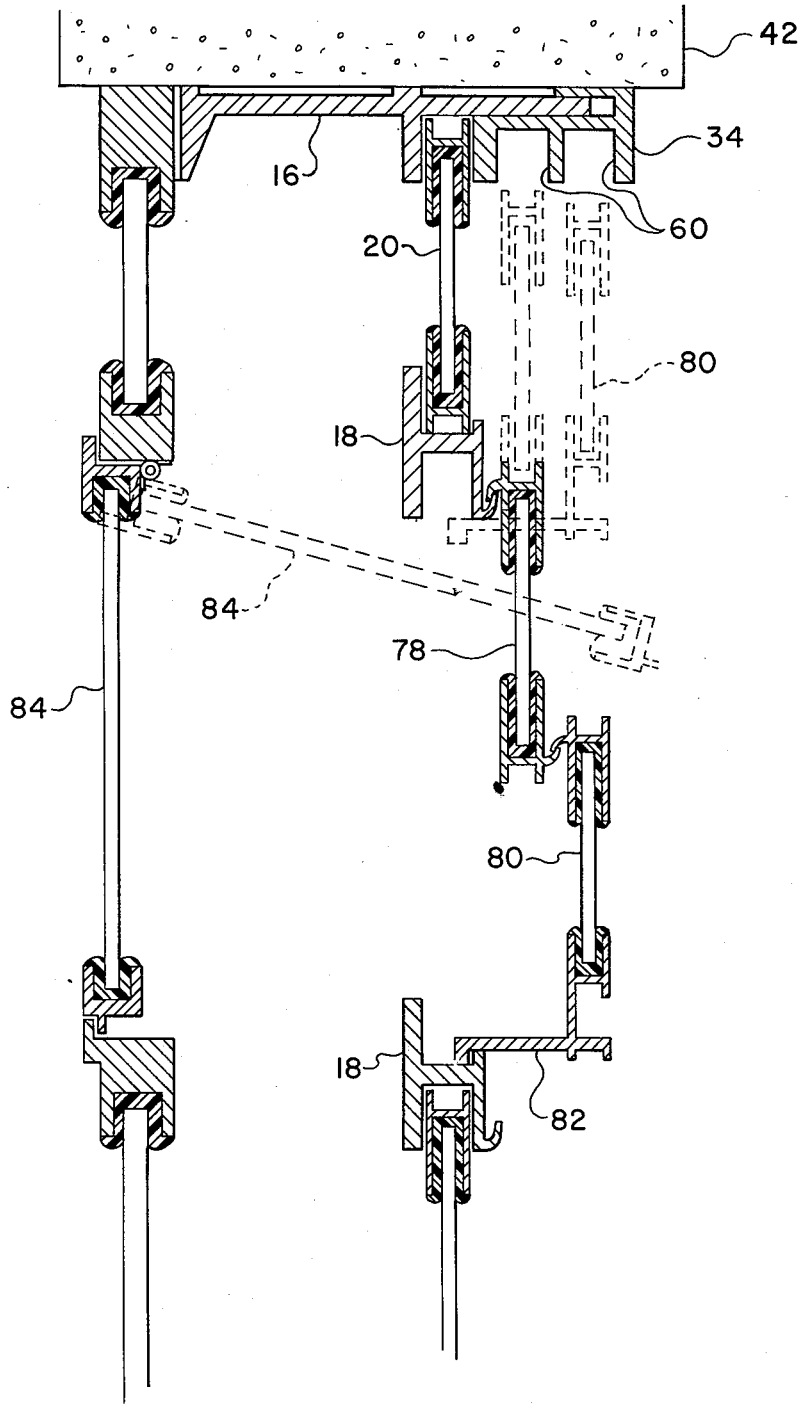
FIG. 6 is a cross sectional view of the present invention taken along lines 6—6 of FIG. 1.

Referring to FIG. 6, which is a sectional view taken along lines 6—6 of FIG. 1, the particular overlapping movement of sashes in storm window 12 are shown. Basically the main frame 16 and removably attached runner extrusion 34 are utilized in the same manner as hereinabove described. A mullion and its associated stationary sash are also illustrated in their previously described configuration. However, this particular storm window incorporates two or more movable sashes with the possibility of adding an additional mullion being possible. As illustrated, the two movable sashes 78 and 80 are slidably secured within grooves 60 of runner extrusion 34. If a second mullion 18 is incorporated to support the lower movable sash in the closed mode, then a sealing flange 82 is adapted to the lower movable sash 80 to provide a sealing means with said mullion. FIG. 6 additionally illustrates one example of a movable sash existing on a primary window unit 84.

In actual application, the storm window system of the present invention may be adapted to a variety of primary window units having movable sashes. It will be appreciated by one skilled in the art that the storm window system of the present invention incorporates a main frame structure of such a low profile that when the proper storm window sash configuration is adopted, there is no obstruction of primary window unit sash movement. Therefore, it should be understood that the movable sashes of the present invention may be adapted to move both vertically or horizontally as may be required. In the case of horizontal moving storm sashes, a vinyl strip may be inserted in the groove of the runner extrusion thereby providing for smooth operation of the sash.

After the size and particular sash configuration to be used has been established, the storm window of the present invention is ready to be installed adjacent the interior side of the primary window unit for which it was designed. Initially the main frame and its associated acoustic interface are placed adjacent a primary window unit and secured to the frame of the primary window unit by screws or other suitable attaching means. Next any mullion and stationary sashes which are to be used are then positioned and secured in their predetermined locations. Lastly the runner extrusions and associated moving sashes are installed in the manner previously mentioned.

The surface of the runner extrusion which is visible from the interior of the building may serve as a mounting surface for window accessories such as blinds, curtains, etc. In addition, provisions exist for adaptation of screen material to the main frame of the storm window.

For normal maintenance of the primary window unit, such as cleaning, the movable storm window sashes are opened thereby permitting convenient access to the primary window unit. In the event that repair or replacement of the primary window sash is necessary, then the storm window sashes may be removed by detaching the runner extrusions and mullion from the main frame.

It is obvious from the foregoing specification that the storm window system of the present invention provides a useful and extremely versatile storm window system which may be adapted to a variety of primary window units. Furthermore, the storm window system of the present invention insulates the interior of the building from both acoustic and thermal conditions which may exist exteriorly of the same.

The terms "upper", "lower", "upward", "forward", "rearward", etc., have been used herein merely for the convenience to describe the improved storm window and its parts as oriented in the drawings. It is to be understood, however, that these terms are in no way limiting to the invention since the improved storm window may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range are intended to be embraced herein.

What is claimed is:

1. An improved storm window for use in conjunction with a primary window disposed within a window opening of a building, comprising: a main frame disposed interiorly of and generally about an area adjacent the primary window to be insulated, said main frame including an inside terminal edge that terminates interiorly of the primary window and which abuts to the inside periphery thereof; said main frame further including an elongated member that extends inwardly from said inside terminal edge along and adjacent said primary window opening and includes a tongue type coupling extension that extends from the end opposite said terminal edge and which is spaced inwardly from the primary window opening; a runner extrusion assembly adapted to be detachably mounted to the tongue type coupling extension of said elongated member of said main frame, said runner extrusion assembly including a tongue receiving opening for receiving said tongue type coupling extension of said elongated member of said main frame and wherein said tongue receiving opening is formed by first and second extensions that form a part of said runner extrusion assembly, said first extension extending between said primary window opening and said elongated member of said main frame and said second extension extending adjacent the inside of said elongated member of said main frame on the side opposite said first extension; said runner extrusion assembly further including at least two runner extrusions extending inwardly from said second extension to form a groove interiorly of said primary window; means for detachably securing said runner extrusion assembly to said elongated member of said main frame; and sash means secured within said runner extrusions in spaced apart relationship with respect to said primary window to form a storm window interiorly of said primary window.

2. The storm window of claim 1 wherein said main frame and attached runner extrusion are low profile.

3. The improved storm window of claim 1 wherein said main frame includes a series of inwardly spaced legs that extend from said elongated member towards said primary window opening and which engages the same so as to maintain said elongated member in a position generally spaced inwardly from said primary window opening.

4. The improved storm window of claim 1 wherein said storm window thereof is provided with an intermediate frame structure for supporting two separate storm window arrangements in side-by-side relationship, said intermediate frame structure being comprised at each of two vertically spaced locations within said primary window opening of two main frame sections coupled together in back-to-back relationship, and two runner extrusion assembly sections disposed in back-to-back relationship with each being coupled to a respective main frame section such that there is defined two separate storm windows within said single primary window opening with said intermediate frame structure supporting each of the storm windows about an area intermediate the extreme sides of the primary window opening.

5. The storm window of claim 1 wherein a vibration dampening interface is provided between said main frame and said primary window unit whereby acoustical vibrations are dampened between the primary window and the storm window.

6. The storm window of claim 5 including a plurality of sashes operatively associated with said runner extrusion assembly.

7. The storm window of claim 6 wherein at least three sashes are provided.

8. The storm window of claim 7 wherein said sashes are overlappingly movable.

* * * * *